US007651239B2

(12) United States Patent
Spartano et al.

(10) Patent No.: US 7,651,239 B2
(45) Date of Patent: Jan. 26, 2010

(54) INTRINSICALLY SAFE FLASHLIGHT

(75) Inventors: David Spartano, Brunswick, OH (US); Peter F. Hoffman, Avon, OH (US)

(73) Assignee: Eveready Battery Co., Inc., St. Louis, MO (US)

( * ) Notice: Subject to any disclaimer, the term of this patent is extended or adjusted under 35 U.S.C. 154(b) by 88 days.

(21) Appl. No.: 11/523,149

(22) Filed: Sep. 19, 2006

(65) Prior Publication Data

US 2008/0068832 A1 Mar. 20, 2008

(51) Int. Cl.
*F21L 4/02* (2006.01)
*F21L 4/04* (2006.01)

(52) U.S. Cl. ..... 362/184; 362/205; 362/376; 362/800

(58) Field of Classification Search ..... 362/184, 362/205, 373, 376–378, 800
See application file for complete search history.

(56) References Cited

U.S. PATENT DOCUMENTS

| | | | | |
|---|---|---|---|---|
| 4,164,145 | A | 8/1979 | Aron | |
| 4,346,329 | A * | 8/1982 | Schmidt | 362/800 |
| 5,149,190 | A * | 9/1992 | MacKenzie | 362/800 |
| 5,386,592 | A * | 2/1995 | Checkeroski | 2/209.13 |
| 5,685,632 | A | 11/1997 | Schaller et al. | |
| 6,556,067 | B2 * | 4/2003 | Henry | 327/536 |
| 6,727,805 | B2 | 4/2004 | Hollister et al. | |
| 6,798,348 | B1 | 9/2004 | Wilker et al. | |
| 6,857,756 | B2 | 2/2005 | Reiff et al. | |
| 6,857,758 | B1 | 2/2005 | Sharrah et al. | |
| 6,859,145 | B2 | 2/2005 | Wilker et al. | |
| 6,979,100 | B2 | 12/2005 | Reiff et al. | |
| 6,987,366 | B2 * | 1/2006 | Yu | 315/291 |
| 7,186,000 | B2 * | 3/2007 | Lebens et al. | 362/184 |
| 2004/0124782 | A1 * | 7/2004 | Yu | 315/200 A |
| 2005/0040773 | A1 | 2/2005 | Lebens et al. | |
| 2006/0109662 | A1 * | 5/2006 | Reiff et al. | 362/373 |
| 2007/0159816 | A1 * | 7/2007 | Bayat et al. | 362/184 |

FOREIGN PATENT DOCUMENTS

| | | | |
|---|---|---|---|
| EP | 0358417 | A | 3/1990 |
| SU | 1154461 | A1 | 5/1985 |
| WO | 9324789 | A | 12/1993 |
| WO | 2004025168 | A1 | 3/2004 |

OTHER PUBLICATIONS

Patent Cooperation Treaty (PCT), International Search Report and Written Opinion for Application PCT/US2007/020168, filed Sep. 18, 2007, mailed Jan. 23, 2008, European Patent Office, Netherlands.

(Continued)

*Primary Examiner*—Stephen F Husar
(74) *Attorney, Agent, or Firm*—Gregory J. Adams

(57) ABSTRACT

An intrinsically safe flashlight (100) includes a housing (100), a battery receiving region (108), an active electrical circuit (202), and a light source (118). The active electrical circuit (202) uses energy from batteries (110) received in the batter receiving region (110) of the flashlight (100) to power the light source (118). The electrical circuitry of the flashlight (110) is energy limited so that the flashlight is intrinsically safe for use in hazardous locations.

13 Claims, 3 Drawing Sheets

OTHER PUBLICATIONS

Analog Devices, Leading Semiconductors for Wireless Handsets, data sheet, 1995-2006, 12 pages.
Dallas Semiconductors, Maxim Application note 725 DC/DC Conversion without Inductors, Dec. 29, 2000, 8 pages, http://www.maxim-ic.com/legal.
Batteries in a Portable World, Protection Circuits, 2001, 4 pages.
Ecom Instruments, Lite-Ex HD 10, Instruction Manual, Feb. 2001, 7 pages, www.ecom-ex.com.
Ecom Instruments, Intrinsically-Safe Handlamp H-4 DC A, data sheet and instruction manual, Nov. 2001, 12 pages, www.ecom-ex.com.
Communications-Applied Technology, AMCVIS—Advanced Multi-Channel Vehicle Intercom System Field Commentary, 2001-2003, 1 page.
Communications-Applied Technology, AMCVIS—Advanced Multi-Channel Vehicle Intercom System Frequently Asked Questions, 2001-2003, 1 page, Reston, Virginia.
Communications-Applied Technology, AMCVIS—Advanced Multi-Channel Vehicle Intercom System Price List, 2001-2003, 5 pages, Reston, Virginia.
Communications-Applied Technology, AMCVIS—Advanced Multi-Channel Vehicle Intercom System Documentation, 2001-2003, 1 page, Reston, Virginia.
Communications-Applied Technology, Headsets for Intrinsically Safe Wireless Intercom System product sheet, 2001-2003, 2 pages, Reston, Virginia.
Communications-Applied Technology, Headsets for Intrinsically Safe Wireless Intercom System Description and Features, 2001-2003, 4 pages, Reston, Virginia.
Communications-Applied Technology, Products from Communication-Applied Technology Product Links and Presentations sheet, 2001-2003, 2 pages, Reston Virginia.
Ecom Instruments, Intrinsically-Safe Laserpointer Ex-Point 01 data sheet, 2001-2004, 1 page, http://www.ecomus-ex.com/us/products/flashlights/laserpointer01/detai....
Dallas Semiconductor, Maxim Application Note 1021 Buck/Boost Charge-Pump Regulator Powers White LEDs from a Wide 1.6V to 5.5V Input, Mar. 27, 2003, 2 pages, http://www.maxim-ic.com/an1021.
Dallas Semicondutors, Maxim Application Note 1037 Charge-Pump Step-Up DC-DC Converter Solutions for Powering White LEDs in Series or Parallel Connections, Apr. 23, 2002, pp. 1-12.
AEMC Instruments, Digital Ground Resistance Tester Models 4620 & 4630 data sheet, Aug. 2002, pp. 1-7, www.aemc.com.
Underwritters Laboratories, Inc. (UL), UL 913 Intrinsically Safe Apparatus and Associated Apparatus for Use in Class I, II, and III, Division 1, Hazardous (Classified) Location, Aug. 8, 2002, pages title p. B2, sixth edition.
Ecom Instruments, Intrinsically Safe LED pocket Flashlight Lite-Ex LED 30 data sheet, downloaded Feb. 2002, 1 page.
Ken Wasko, The Inside on Intrinsically Safe Radios, Private Wireless, Mar. 2003, pp. 14-16.
Gree Lighting, Cree XLamp 7090 Packaged LEDs data sheet, 2004, pp. 1-19, www.cree.com/xlamp.
3D Instrumnets, LLC, DPG-6600 Battery-Powered Digital Gauge data sheet, 2004, 4 pages, Anaheim CA.
Hazardous Area Direct, i.roc 627 FM Class 1 Div. 1/ ATEX Zone 1 PDA + 1 GB data sheet, 2004, 6 pages.
Linear Technology, LTC3204-3.3/LTC3204-5/LTC3204B-3.3/LTC3204B-5 Low Noise Regulated Charge Pump in 2×2 DFN data sheet, 2004, pp. 1-12, Milpitas, CA, www.linear.com.
Hazaedous Area Direct, TMRT 1Ex Intrinsically Safe Laser Tachometer data sheet, 2004, 3 pages.
BEKA Associates, Ltd, Instruction sheet for BA369 Intrinsically safe battery powered clock, Dec. 2004, pp. 1-4, www.beka.co.uk.
Linear Technology, LTC3215 700mA Low Noise High Current LED Charge Pump data sheet, 2005, pp. 1-12, Milpitas, CA, www.linear.com.
Bluechips Technology, BCT3511S DC/DC Converter for 1 Watt White LED data sheet, 2005, pp. 1-9, www.bluechipstech.com.
Underwritters Laboratories, Inc., Definitions of Commonly used hazardous locations terminology, Hazardous Locations, 2005, 6 pages.
Energizer, 459 Industrial Flashlight Engineering Datasheet, May 2005, 1 page, www.energizer.com.
Energizer, 1259 Industrial Safety Flashlight Engineering Datasheet, May 2005, 1 page, www.energizer.com.
Energizer, 1359 Industrial Flashlight Engineering Datasheet, May 2005, 1 page, www.energizer.com.
SA Ex Instruments, The Lite-Ex 15, 20, 23, 25 series of Explosion Proof Flashlights product sheet, 2006, 2 pages.
SA Ex Instruments, The L2000 Explosion Proof Rechargeable Flashlight product sheet, 2006, 2 pages.
Hazardous Area Direct, Definitions of Classes and Zones, downloaded Jul. 26, 2006, 10 pages, http://www.hazardousareadirect.com/ClassificationInfo/Definitions.htm.
Author Unknown, Hazardous (Classified) Locations, downloaded Aug. 15, 2006, pages 13-25, http://www.labtrain.noaa.gov/osha600/mod07/0713—.htm.
Author Unknown, Intrinsic Safety Basic Principles, Technology For Safety, downloaded Aug. 17, 2006, pp. 159-172.
Omega, OM-CP-RHTEMP1000IS Intrinsically Safe Humidiy and Temperature Datalogger data sheet, downloaded Aug. 17, 2006, 2 pages, omega.com.
GM International Technology for Safety, Understanding Hazardous Location data sheet, downloaded Aug. 17, 2006, 1 page, www.gmisafety.com.
Ecom Instruments, Intrinsically-Safe Ultrasonic Wall Thickness Gauge 1071-Ex data sheet, downloaded Sep. 11, 2006, 1 page, www.ecom-ex.com.
Metrix, MX 57Ex 50,000 -count TRMS Digital Multimeter data sheet, 2 pages, downloaded Sep. 12, 2006, www.chauvin-arnoux.co.uk.
Ecom Instruments, Ex-Penlight data sheet and operating instructions, downloaded Sep. 12, 2006, 9 pages, www.ecom-ex.com.
Ecom Instruments, Lite-Ex LED 30 operating instructions, downloaded Sep. 12, 2006, 9 pages, www.ecom-ex.com.
U.S. Application of Spartano et al., entitled Intrinsically Safe Battery Powered Power Supply, submitted to the U.S. Patent Office on Sep. 19, 2006, U.S. Appl. No. 11/523,157.
Patent Cooperation Treaty (PCT) International Search Report and Written Opinion for Application No. PCT/US2007/020171, filed Sep. 18, 2007, mailed Apr. 22, 2008, European Patent Office, Netherlands.
Communication pursuant to Article 94(3) EPC, European Patent Office, 80298 Munich, Germany, Application No. 07 838 385.8 - 2423, Mailed Oct. 8, 2009.

* cited by examiner

INTRINSICALLY SAFE FLASHLIGHT

BACKGROUND

The present application relates to portable, battery powered light sources for use in hazardous locations. While it finds particular application to intrinsically safe flashlights, the application also relates to other portable and hand-held lighting devices suitable for use in environments which present a risk of fire or explosion.

Battery powered flashlights and other portable lighting devices are ubiquitous in home, commercial, industrial, and other environments. Unless specifically designed, however, battery powered flashlights are not typically suited for use in hazardous locations.

Hazardous (classified) locations include those locations in which ignitable concentrations of flammable or combustible materials are or may reasonably be expected to be present in the atmosphere. Such conditions are sometimes encountered in mines, refineries, and other industrial environments in flammable or combustible atmospheres may be present.

Depending on the classification scheme, hazardous locations may be classified in various ways. In North America, for example, a Class I, Division 1 hazardous location is a location where ignitable concentrations of flammable gases, vapors or liquids can exist under normal operating conditions, may frequently exist because of repair or maintenance operations or because of leakage, or may exist because of an equipment breakdown that simultaneously causes the equipment to become a source of ignition. Under a classification standard which is used outside of North America, a Zone 0 hazardous location is a location where an explosive gas-air mixture is continuously present or present for long periods.

Various techniques have been used to render electrical equipment suitable for use in hazardous locations. One technique involves the use of an explosion-proof housing. An explosion proof housing is designed to withstand an explosion occurring within it and to prevent the ignition of combustible materials surrounding the housings. Explosion-proof housings also operate at an external temperature below that which is sufficient to ignite surrounding materials. While explosion-proof housings can be quite effective, they tend to be both expensive and physically large, rendering them relatively unattractive for use in applications in which cost or physical size is a factor.

Another technique involves the use of purging, in which an enclosure is supplied with a protective gas at a sufficient flow and positive pressure to reduce the concentration of a flammable material to an acceptable level. However, purging systems can be relatively complex, and a source of purge gas may not readily available.

Another technique involves the use of intrinsically safe electrical circuits. Intrinsically safe circuits are typically energy limited so that the circuit cannot provide sufficient energy to trigger a fire or explosion under normal operating or fault conditions. One definition of an intrinsically safe circuit which is sometimes used in connection with the certification of intrinsically safe equipment is contained in Underwriters Laboratory (UL) Standard 913, entitled Intrinsically Safe Apparatus and Associated Apparatus for Use in Class I, II, and III, Division 1, Hazardous (Classified) Locations. According to this definition, an intrinsically safe circuit is one in which any spark or thermal effect, produced normally or in specified fault conditions, is incapable, under the test conditions proscribed in [the UL 913] standard, of causing ignition of a mixture of a flammable or combustible material in air in the mixture's most easily ignitable concentration.

One intrinsically safe flashlight has included three (3) light emitting diodes (LEDs) each having a nominal forward voltage of about 3.6 volts direct current (VDC). The flashlight has been powered by three (3) 1.5 VDC Type N batteries, with an energy limiting resistor disposed electrically in series between the batteries and the LEDs. A particular disadvantage of such a configuration, however, is that three (3) batteries are required to supply the nominal 3.6 VDC forward voltage of the LEDs. A still further disadvantage is that the current supplied to the LEDs is a function of the battery voltage, the LED forward voltage, and the series resistance. As a result, the intensity of the light produced by the flashlight can vary significantly as the batteries discharge. Moreover, such a configuration utilizes the energy from the batteries relatively inefficiently, so that the flashlight is relatively bulky for a given light output and operating time.

Other intrinsically safe flashlights have included an incandescent, krypton, xenon, halogen, or vacuum tube bulb powered by two (2) or three (3) nominal 1.5 VDC batteries, again connected electrically in series through a current limiting resistor. This configuration likewise suffers from variations in light intensity and a relatively inefficient utilization of the available battery energy. While the bulbs can be operated on the voltage supplied by only two (2) batteries, they are not well-suited for use in intrinsically safe applications.

SUMMARY

Aspects of the present application address these matters, and others.

According to one aspect, an intrinsically safe flashlight includes a battery receiving region which accepts two or fewer generally cylindrical batteries, at least a first light emitting diode, and a converter circuit which converts electrical energy from the two or fewer batteries to a form suitable for powering the at least a first light emitting diode, wherein the flashlight is intrinsically safe for use in a hazardous location.

According to another aspect, an intrinsically safe, battery powered flashlight includes a first light source, a battery receiving region, and an intrinsically safe, active electrical circuit which uses energy from a battery received in the battery receiving region to power the light source.

According to another aspect, a method includes receiving electrical energy from a battery disposed in a battery receiving region of a flashlight and using an intrinsically safe active electrical circuit to supply electrical energy received from the battery to a first light source of the flashlight.

According to another aspect, a human-portable lighting apparatus includes a battery receiving region adapted to receive at least a first battery, a user operable control, a light emitting diode light source, and an intrinsically safe, closed loop control circuit means operatively connected to the user control for using energy from the at least a first battery to selectively power the light source.

Those skilled in the art will recognize still other aspects of the present application upon reading and understanding the attached description.

BRIEF DESCRIPTION OF THE DRAWINGS

The present application is illustrated by way of example and not limitation in the figures of the accompanying drawings, in which like references indicate similar elements and in which.

DETAILED DESCRIPTION

Figure 1:
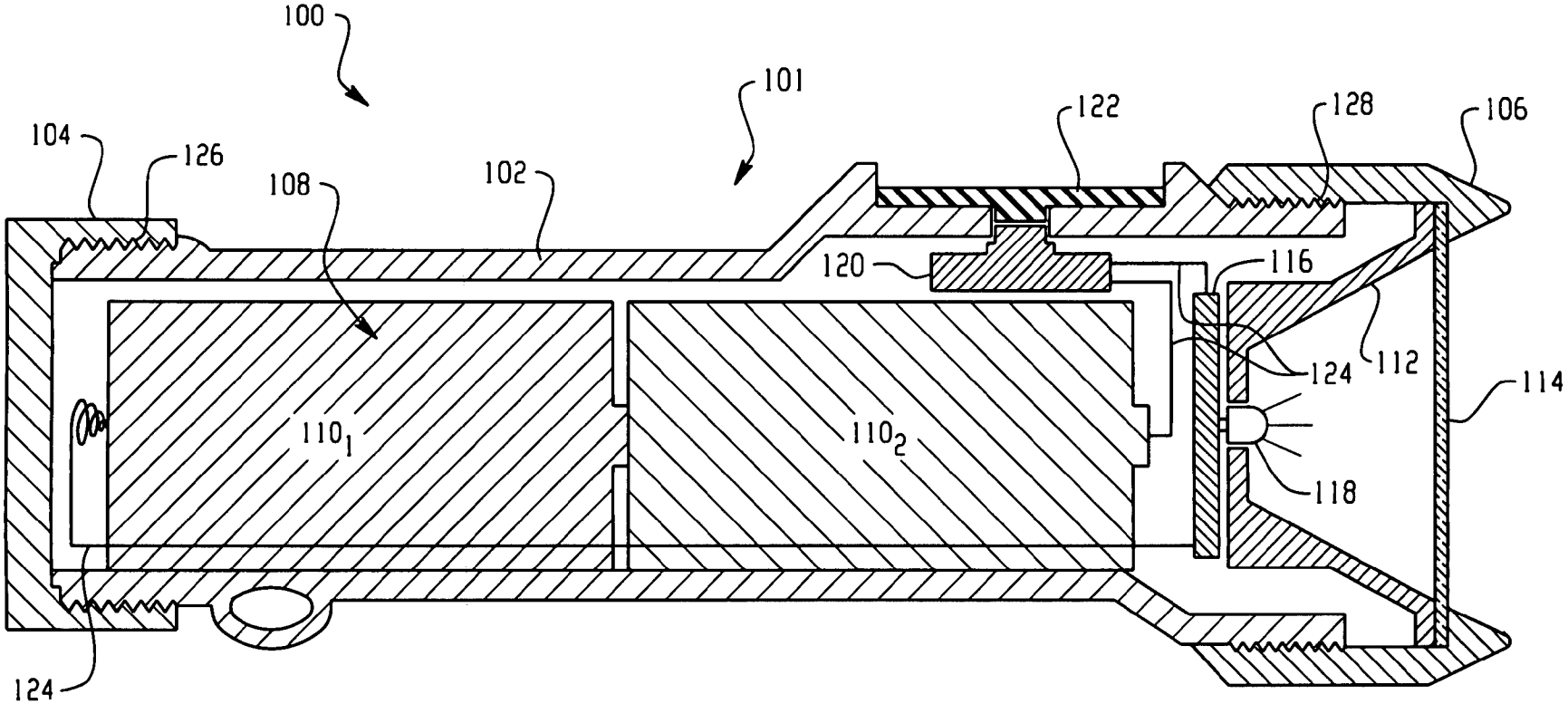
FIG. 1 is a cross-sectional view of a flashlight.

With reference to FIG. 1, an intrinsically safe flashlight 100 includes a generally cylindrical housing 101 which defines a battery receiving region 108 configured to receive first $\mathbf{110}_1$ and second $\mathbf{110}_2$ batteries such as generally cylindrical D-size cells. As illustrated, the housing includes a generally cylindrical body 102, a first end cap 104, and a second end cap 106. The end caps 104, 106 are removably attached to the body 102, for example through threads 126, 128.

The flashlight 100 also includes a light management system such as a generally parabolic reflector 112 and lens 114, a circuit board 116, and a light source 118 such as one or more light emitting diodes (LEDs) which, as illustrated, are carried by the second end cap 106. A user-operable switch 120 such as a pushbutton on/off switch allows a user to control the operation of the flashlight 100 as desired. As illustrated in FIG. 1, the switch 120 is actuated through a flexible switch cover 122.

The batteries 110, switch 120 and circuit board 116 configured as an intrinsically safe electrical circuit suitable for use in hazardous locations and through which energy from the batteries 110 is used to selectively illuminate the light source 118.

Figure 2:
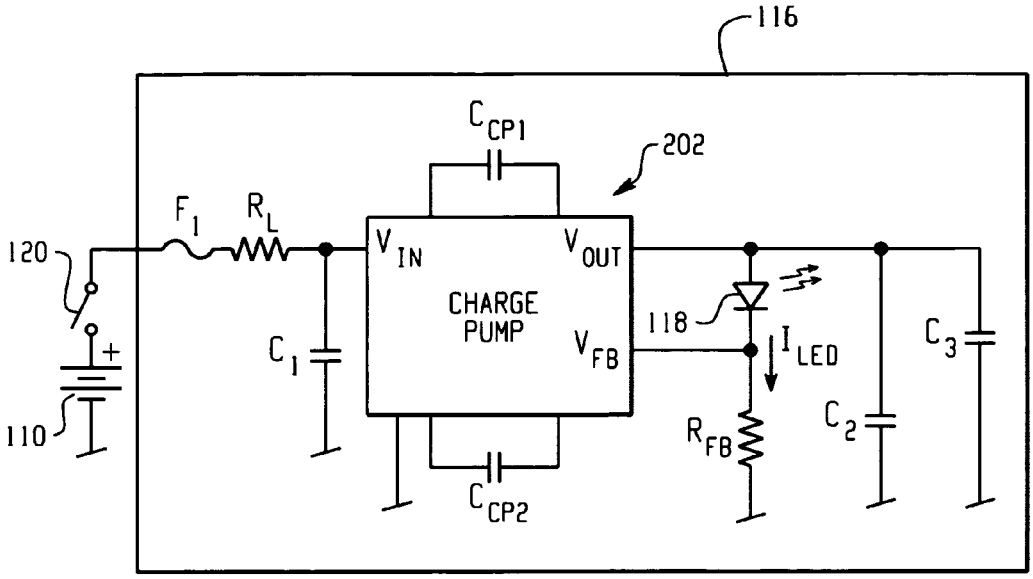
FIG. 2 is a schematic diagram of a first circuit.

Turning now to FIG. 2, the circuit includes active electrical circuitry 202 such as a direct current to direct current (DC to DC) converter circuit 202. The converter circuit 202, which is configured as a capacitive charge pump, uses charge pump capacitors $C_{CP1}$, $C_{CP2}$ to convert the energy provided by the batteries 110 to a form suitable for powering the light source 118. While converter circuits 202 which utilize capacitive energy storage elements are especially well suited for intrinsically safe applications, inductive or other energy conversion elements may also be implemented.

As the batteries are ordinarily capable of supplying energy sufficient to render the flashlight 100 non-intrinsically safe, an energy limiter such as a fuse $F_1$ and a current limiting resistor $R_L$ are disposed electrically in series between the batteries 110 and the input $V_{in}$ of the converter circuit 202. The fuse $F_1$ and current limiting resistor $R_L$ cooperate to limit the available energy so that any spark or thermal effect produced during normal operation or under fault conditions is incapable of causing ignition of a mixture of a flammable or combustible material in air in the mixture's most easily ignitable concentration. The energy limiter should be located as near as practicable to the battery receiving region 108, and the requisite electrical connections 124 should be suitably spaced and insulated so as prevent or otherwise reduce the likelihood of shorts, opens, or other faults.

The light source 118 is connected to the output $V_{out}$ of the charge pump 202. In one implementation, the light source 118 is a 1 Watt (W) white LED. Such LEDs typically have a nominal forward voltage of approximately 3.6 VDC (with specification limits typically ranging from roughly 3 to 4 VDC) and an operating current of approximately 350 milliamperes (mA). Where the flashlight 100 is powered by two (2) series connected alkaline primary batteries each having a nominal open circuit output voltage of 1.5 VDC, the nominal open circuit input voltage to the charge pump is about 3 VDC. Two series connected Nickel Metal Hydride (NiMH) secondary batteries having a nominal open circuit output voltage of 1.2 VDC likewise provide a nominal voltage 2.4 VDC. Note that the converter circuit 202 is advantageously configured to have an input dynamic range which is suitable for use with either chemistry and which accommodates decreases in input voltage which occur as the batteries 100 are loaded and/or become discharged. In either case, the converter 202 ordinarily serves as a voltage step up or boost converter.

A feedback resistor $R_{FB}$ is connected in series with the light source 118. The resistor $R_{FB}$ provides a feedback signal $V_{FB}$ to the converter circuit 202, which implements a closed loop control circuit which varies the average output voltage $V_{out}$ as needed to maintain the LED current $I_{LED}$ at a desired operating current. In this sense, the converter 202 can be considered to operate as a current source.

One advantage of such an arrangement is that it tends to ameliorate the effects of variations in the performance of the light source 118, as well as changes in battery output voltage, particularly as the batteries 110 discharge. Those of ordinary skill in the art will recognize that, while the illumination provided by the light source 118 is a function of LED current $I_{LED}$, the converter need not function as an ideal current source.

The circuit also includes decoupling capacitors $C_1$, $C_3$ such as 0.01 μF ceramic capacitors and a filter capacitor $C_2$ such as a 1.0 microfarad (μF) electrolytic capacitor.

A suitable charge pump for use in the converter circuit 202 is the BCT3511S DC/DC converter integrated circuit (IC) available from BlueChips Technology of Selangor Darul Ehsa, Malaysia (www.bluechipstech.com). In the case of an intrinsically safe circuit suitable for use in Class I, Division 1, Group A, B, C, and D locations pursuant to the UL913 standard, a suitable fuse $F_1$ is a very fast acting, encapsulated 750 mA fuse such as a Series 263 fuse available from Littlefuse Company of Des Plaines, Ill. USA (www.littlefuse.com). A suitable resistor $R_L$ is a 0.25 Ohm (Ω)+/−5%, 1 Watt (W) resistor. Note also that the thermal characteristics of the various components should be selected so that the temperature rise under fault conditions is insufficient to cause ignition of flammable or combustible materials. Internal wiring and other connections should also be insulated and spaced appropriately. One source of guidance with respect to thermal issues, reactive component values, spacing, and the like is the known UL 913 standard.

Various alternatives are contemplated. The flashlight 100 may be designed as intrinsically safe for use in other classes, divisions or groups (e.g., classes II or III, Division 2, Groups B-G, or the like). The flashlight 100 may also be designed to conform to IEC, ATEX/CENELEC, or other classification standards, for example in Zones 0, 1, or 2.

Figure 3:
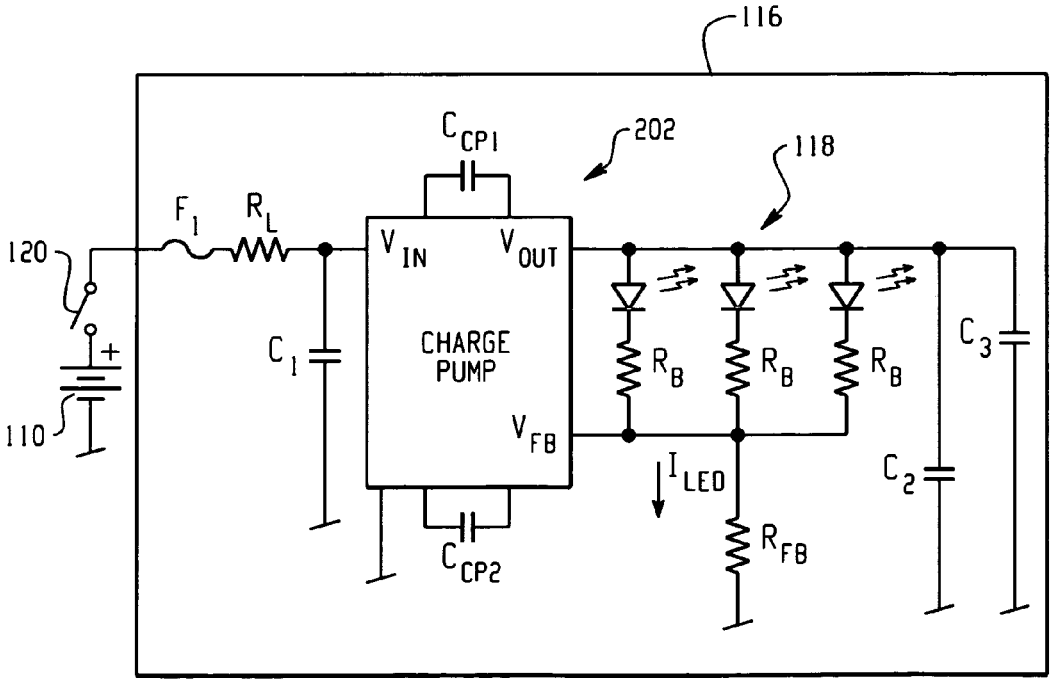
FIG. 3 is a schematic diagram of a second circuit.

While the above discussion has focused on a flashlight having two (2) D-size batteries and a light source which includes a single 1 W LED, other battery types and/or light sources 118 are contemplated. In one variation, the flashlight 100 is configured to accept two (2) AA size batteries and the light source 118 includes three (3) 72 mW LEDs. A suitable circuit implementation is shown in FIG. 3. Note that a ballast resistor $R_B$ such as a 4.7Ω resistor is placed in series with each LED, and the value of the feedback resistor $R_{FB}$ is selected so that the total LED current $I_{LED}$ is approximately 175 mA.

The flashlight may also be designed to accept AAA-size, C-size, Type N, other generally cylindrical batteries, prismatic batteries, coin cells, or other batteries, either alone or in combination. Other chemistries are also contemplated, including but not limited to lithium ion (Li Ion), lithium iron disulfide ($Li/FeS_2$), and nickel cadmium (NiCd), provided that the batteries are otherwise suitable for use in the desired hazardous location. The flashlight 100 may also be configured to accept only a single battery 110 or three (3) or more batteries 110.

Other numbers and wattages of LEDs may also be provided, as may colors other than white. Examples include cyan, green, amber, red-orange, and red. Two (2) or more of the LEDs may also be connected electrically in series.

While the above discussion has focused on a flashlight 100 having a generally cylindrical form factor, other form factors are also contemplated. For example, the flashlight may be configured as a lantern style flashlight or as a wearable light. In one variation, the flashlight 100 includes clip or carabineer for attaching the flashlight to a belt or other article of clothing. In still another variation, the flashlight 100 is configured as a headlamp, for example as part of headgear such as a safety hardhat or connected to a headband which is worn around the user's head. The flashlight 100 may also include one or more flat surfaces which facilitate placement of the flashlight on suitable surface. It may also include suitable clamps, brackets, cut and loop fasteners, magnets, or other fasteners for selectively attaching the flashlight 100 to an object in the external environment.

The flashlight 100 may also be configured to produce other than a light beam, for example to provide an area light. It may also include more than one independently controllable light source 118, batteries 110, and/or circuits 202. Thus, for example, one light source 118 may provide a light beam while another serves as an area light. The flashlight may also include a light source 118 which serves as a distress or signal light, for example by flashing and/or emitting a red or other suitably colored light. The intensity of the light provided by a light source 118 may be varied by varying the value of its feedback resistor $R_{FB}$, for example via a potentiometer, switch, or other user operable brightness control. In one implementation, the intensity is substantially continuously variable. In another, the intensity is variable between three or more levels, for example between an off state and two (2) or more illuminated conditions. Where the light source 118 includes multiple LEDs, the illumination intensity may also be varies by selectively powering one or more of the LEDs.

Other converter 202 implementations are also contemplated. For example, the converter 202 may be implemented using other DC to DC converter ICs, discrete circuitry, or combinations thereof. Note also that the filter capacitor $C_2$ may be omitted, particularly where the switching frequency of the converter circuit 202 is fast enough so that any resultant flicker in the LED output is not noticeable or otherwise acceptable.

Other converter topologies are also contemplated. Additional circuits are discussed in commonly owned U.S. patent application Ser. No. 12/429,435 to Spartano et al., and entitled Intrinsically Safe Battery Powered Power Supply, filed on even date herewith and which is expressly incorporated by reference in its entirety herein.

Note also that the switch 120 may also be located on the negative side of the batteries 110. The switch 120 may also be implemented as a slide, toggle, rocker, rotary, or other switch.

Figure 4:
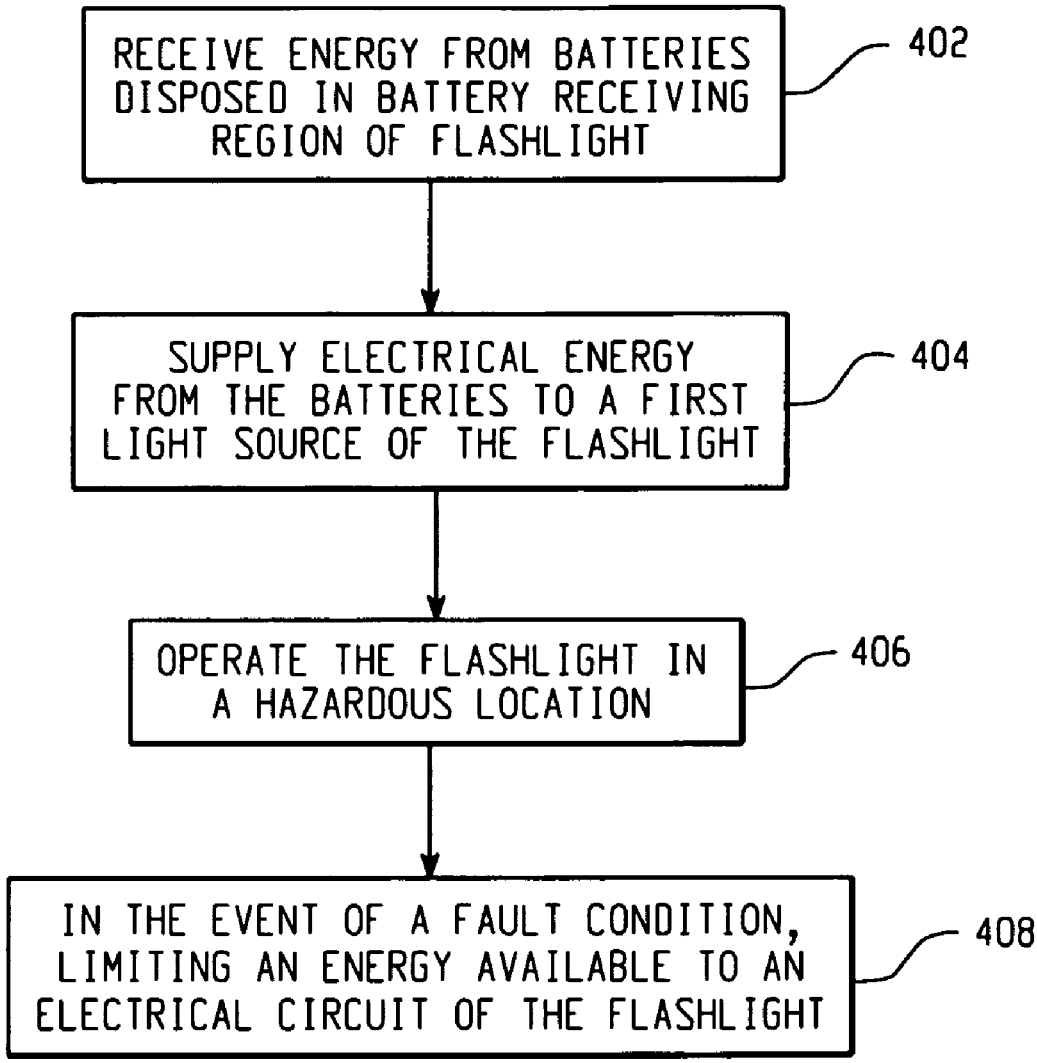
FIG. 4 depicts a method of operating a flashlight.

Operation of the flashlight 100 will now be described in relation to FIG. 4. At 402, electrical energy is received from a battery or batteries disposed in the battery receiving region 108 of the flashlight. At 404, the electrical circuit 202 supplies energy from the battery(ies) to the light source 118. At 406, the flashlight 100 is operated in a hazardous location. In the event of a fault condition such as a component failure or a short circuit, the fuse $F_1$ and the current limit resistor $R_L$ limit the available energy at step 408.

The invention has been described with reference to the preferred embodiments. Of course, modifications and alterations will occur to others upon reading and understanding the preceding description. It is intended that the invention be construed as including all such modifications and alterations insofar as they come within the scope of the appended claims and the equivalents thereof.

What is claimed is:

1. An intrinsically safe flashlight comprising:

a battery receiving region which accepts two or fewer generally cylindrical batteries;

at least a first light emitting diode;

a step up converter circuit which steps up electrical energy from the two or fewer batteries to a form suitable power for powering the at least a first light emitting diode; and an energy limiter, including a fuse and a current limiting resistor, wherein the fuse and the current limiting resistor cooperate to limit available energy so that any thermal effect produced during operation is incapable of causing ignition of a mixture of a flammable or combustible material in air in the mixture, wherein the flashlight is intrinsically safe for use in a hazardous location.

2. The flashlight of claim 1 wherein the two or fewer batteries are nominal 1.2 or 1.5 VDC batteries and the at least a first light emitting diode has a forward voltage between about 3 and 4 VDC.

3. The flashlight of claim 1 wherein the energy provided to the converter circuit is limited so that the flashlight is intrinsically safe for use in a location where ignitable concentrations of flammable gases, vapors or liquids can exist under normal operating conditions, may frequently exist because of repair or maintenance operations or because of leakage, or may exist because of an equipment breakdown that simultaneously causes the equipment to become a source of ignition.

4. The flashlight of claim 1 wherein the converter circuit includes a capacitive voltage converter.

5. The flashlight of claim 1 wherein the converter circuit includes a capacitive charge pump.

6. The flashlight of claim 1 wherein the converter circuit receives a signal indicative of a current through the at least as first light emitting diode.

7. The flashlight of claim 1 wherein the flashlight has a generally cylindrical exterior form factor.

8. The flashlight of claim 1 including a reflector which reflects light produced by the at least a first light emitting diode and the flashlight generates a light beam.

9. The flashlight of claim 1 wherein the flashlight provides an area light.

10. The flashlight of claim 1 wherein the battery receiving region accepts 2 D-size batteries.

11. The flashlight of claim 1 wherein the battery receiving region accepts 2 AA-size batteries and the flashlight includes a plurality of light emitting diodes.

12. The flashlight of claim 1 including user-operable means for varying an intensity of the light produced by the at least one light emitting diode to at least a first non-illuminated level, a first illuminated level, and a second illuminated level.

13. The apparatus of claim 1 including a lantern-style flashlight housing.

* * * * *

UNITED STATES PATENT AND TRADEMARK OFFICE

CERTIFICATE OF CORRECTION

PATENT NO. : 7,651,239 B2
APPLICATION NO. : 11/523149
DATED : January 26, 2010
INVENTOR(S) : Spartano et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 207 days.

Signed and Sealed this

Twenty-eighth Day of December, 2010

David J. Kappos

David J. Kappos
*Director of the United States Patent and Trademark Office*